US006467324B2

(12) United States Patent
Patrick

(10) Patent No.: US 6,467,324 B2
(45) Date of Patent: Oct. 22, 2002

(54) DIE HEMMING ASSEMBLY AND METHOD

(76) Inventor: William Patrick, 81 Willow Beach Road, RR#2, Amherstburg, Ontario (CA), N9V 2X8

( * ) Notice: Subject to any disclaimer, the term of this patent is extended or adjusted under 35 U.S.C. 154(b) by 0 days.

(21) Appl. No.: 09/793,422

(22) Filed: Feb. 27, 2001

(65) Prior Publication Data

US 2002/0116976 A1 Aug. 29, 2002

(51) Int. Cl.[7] ..... B21D 39/02

(52) U.S. Cl. ..... 72/312; 72/306; 29/243.58

(58) Field of Search ..... 72/312–315, 306, 72/322; 29/243.58, 243.57, 243.5

(56) References Cited

U.S. PATENT DOCUMENTS

| | | | | |
|---|---|---|---|---|
| 3,092,057 A | | 6/1963 | Warshilek | |
| 3,143,095 A | * | 8/1964 | Tribe | 29/243.58 |
| 4,346,579 A | | 8/1982 | Takatsu | 29/243.58 |
| 4,484,467 A | * | 11/1984 | Kitano et al. | 72/374 |
| 4,706,489 A | | 11/1987 | Dacey, Jr. | 29/243.58 |
| 4,827,595 A | | 5/1989 | Dacey, Jr. | 29/243.58 |
| 4,901,555 A | | 2/1990 | Shimoichi | 72/322 |
| 4,928,388 A | | 5/1990 | Dacey, Jr. | 29/243.57 |
| 5,005,398 A | | 4/1991 | Evans | 29/243.58 |
| 5,083,355 A | | 1/1992 | Dacey, Jr. | 29/243.58 |
| 5,150,508 A | | 9/1992 | St. Denis | 29/243.5 |
| 5,272,903 A | | 12/1993 | Evans | 29/243.58 |
| 5,315,855 A | | 5/1994 | Jackson | 29/243.58 |
| 5,454,261 A | | 10/1995 | Campain | 72/323 |
| 5,457,981 A | | 10/1995 | Brown et al. | 72/451 |
| 5,495,742 A | | 3/1996 | Dorsett | 29/243.58 |
| 5,507,165 A | | 4/1996 | Hartley | 72/311 |
| 5,611,133 A | | 3/1997 | Toeniskoetter | 29/509 |
| 5,740,691 A | | 4/1998 | Kovarovic et al. | 72/306 |
| 5,746,083 A | | 5/1998 | Kovarovic et al. | 72/315 |
| 5,752,304 A | | 5/1998 | Toeniskoetter | 29/243.58 |
| 5,979,208 A | | 11/1999 | Hartley | 72/306 |
| 6,079,250 A | | 6/2000 | Scannell et al. | 72/381 |

FOREIGN PATENT DOCUMENTS

| | | | |
|---|---|---|---|
| FR | 1322218 | | 3/1963 |
| FR | 1445675 | | 6/1966 |
| GB | 929840 | | 3/1960 |
| JP | 57-124524 | * | 8/1982 |
| JP | 57-184520 | * | 11/1982 |
| JP | 4-157028 | * | 5/1992 |
| JP | 2000-343156 | * | 12/2000 |
| JP | 2001-239323 | * | 9/2001 |

* cited by examiner

*Primary Examiner*—Daniel C. Crane
(74) *Attorney, Agent, or Firm*—Clark & Brody

(57) ABSTRACT

A hemming assembly and method for joining the edges of a pair of panels together includes a main die supporting edges of the two panels, a pre-hem slide supporting a pre-hem tool, a final die holder supporting a final die, and at least one drive to move the tool and die for pre-hemming and final hemming, respectively. A mechanism guides the pre-hem slide first vertically for at least partial pre-hemming, and then at an angle to expose the pre-hemmed edges for final hemming. Vertical travel of the pre-hem tool against the edges produces a superior and less distorted joint, and pre-hemming and final hemming can be performed in one overall stroke. A number of assemblies can be arranged to pre-hem and final hem a number of edges.

21 Claims, 5 Drawing Sheets

DIE HEMMING ASSEMBLY AND METHOD

FIELD OF THE INVENTION

The present invention is directed to a die hemming assembly and method, and in particular to a hemming assembly and method that utilize a vertical motion as part of the pre-hemming operation.

BACKGROUND ART

In the prior art, it is well known to join together a pair of preformed parts into a single unitary structure. This joining is particularly prevalent in the automotive industry where a component such as a hollow door, hood, deck gate, end gate, trunk lid or the like is formed using these joining techniques. Typically, these components comprise an outer and an inner panel. The edges of the panels are clinched together using a hemming machine or apparatus.

A widely-used process for hemming of door panels involves a pre-hemming step followed by a final hemming step. In the pre-hemming step, an upstanding or right-angled flange of one panel is bent over a flat edge of another panel by a pre-hemming die surface. In the final hemming step, the bent flange is flattened onto the flat edge of the other panel to form the hem using a final hemming die surface.

Various types of machines have been proposed to perform these types of hemming operations. One type uses a vertically-driven main die and a horizontally-driven hem gate. The hem gate supports the pre-hemming and final hemming die surfaces and is moved laterally or horizontally for hemming. The main die is raised vertically for the hemming steps. These horizontally-driven gates lack accuracy and repeatability in the hemming process. In these machines, there are typically four separate assemblies to hem each side of a rectangular or square unit. Since each assembly may have its own main die and drive for the hemmers, the overall apparatus is rather clumsy and bulky.

Another type of hemming machine uses a linkage and a swing-type motion to allow the pre-hemming and final hemming surfaces to contact the flange for hemming. The complicated drive mechanisms associated with these machines make them expensive and can cause unwanted variations over time in hemming performance.

Another hemming apparatus is disclosed in U.S. Pat. No. 5,150,508 to St. Denis. This patent discloses a hemming machine using the horizontally-driven hem gate and vertically-driven main die described above. In St. Denis, the main die is raised hydraulically between two positions for pre-hemming and final hemming. A lifter is used to then remove the hemmed part or load a unit to be hemmed. This machine also suffers from the drawbacks noted above.

Another problem with present day hemming apparatus that employ a swinging mechanism for pre-hemming is distortion to the panel. Referring now to FIGS. 1*a* and 1*b*, a pre-hemming operation is schematically depicted wherein panel 1 is hemmed to panel 3 using die 2. The arrow in FIG. 1*a* represents the motion of the pre-hemming tool (not shown), which would contact the end portion 5 of panel 1. FIG. 1*b* shows the panels in the pre-hemmed state with the end portion 5 bent over the edge 7 of the panel 2. Reference numeral 9 shows that lifting and distortion can occur at the bend 11 when the end portion is pre-hemmed using a swinging motion from the pre-hem tool. This lifting and distortion compromises the quality of the hemmed panels, and can result in part rejection.

In light of the disadvantages of prior art hemming machines, particularly the distortion at the hemmed edge when using swinging or arcuate pre-hemming motions, a need has developed to provide improved hemming apparatus and methods. The present invention responds to this need by providing a hemming apparatus employing a pre-hemming mechanism that employs a vertical pre-hemming action, and a pre-hemming mechanism that also cooperates with a vertical final hemming action.

SUMMARY OF THE INVENTION

It is a first object of the present invention to provide an improved hemming apparatus.

Another object of the present invention is to provide an improved method of hemming parts together.

Yet another object of the invention is a hemming apparatus employing a mechanism utilizing a generally vertical force for pre-hemming.

A further object of the invention is a method of hemming panels together wherein pre-hemming is primarily accomplished by a generally vertical action rather than a horizontal or arcuate motion.

A still further object of the invention is the ability to incorporate a number of pre-hemming and final hemming operations in sequence using a single downward motion of the hemming apparatus.

Other objects and advantages of the present invention will become apparent as a description thereof proceeds.

In satisfaction of the foregoing objects and advantages, the present invention provides a die hemming assembly which is improved over prior art types utilizing arcuate pre-hemming motion. The assembly includes components that make up a hemming apparatus, the apparatus adapted for hemming an upstanding edge of a first panel to an edge of a second panel to form a joint. The assembly includes a main die supporting the first and second panels, a pre-hem slide supporting a pre-hem tool that has an angled tool surface, and a final hem die holder supporting a final hem tool. A guide mechanism is in engagement with the pre-hem slide to direct the pre-hem slide along a first path generally vertical to the upstanding edge and along a second path angled with respect to vertical. At least one drive directs the pre-hem slide along the first and second paths and directs the final hem die holder along a generally vertical path. One drive can move both the pre-hem tool and the final hem die, either together or sequentially, or each can have their own drive.

A number of assemblies can be arranged together to hem a number of different edges, either in sequence or simultaneously. The various tools and dies can be appropriately spaced so that, if desired, one press or downward motion cycle can hem all the desired edges.

In one embodiment, the guide mechanism comprises an elongated element having at least one vertical guide surface and at least one angled guide surface. The pre-hem slide has at least one complementary vertical guide surface and at least one complementary angled guide surface. Movement of the at least one complementary vertical guide surface of the-pre-hem slide against the at least one vertical guide surface of the guide member directs the pre-hem tool generally vertically against the upstanding edge for at least a partial pre-hemming. Movement of the at least one complementary angled guide surface of the pre-hem slide against the at least one angled guide surface of the guide member angles the pre-hem tool away from the pre-hemmed edge to complete pre-hemming or permit final hemming.

The guide mechanism of this embodiment includes a horizontal guide to maintain a horizontal orientation of the pre-hem slide during angling movement. The horizontal guide can be a rail linked to the drive, and a set of roller bearings or the like linked to the pre-hem slide. The bearing follow in the rail as the pre-hem slide angles away from the edges to maintain the pre-hem slide in its horizontal orientation.

The main die is supported by a base, which with the main die forms a space to receive the pre-hem slide during its angled movement, thus allowing exposure of the pre-hemmed edges for final hemming.

The invention also entails a method of hemming at least one upstanding edge of one panel to the edge of another panel, whereby the upstanding edge is at least partially pre-hemmed by contacting the upstanding edge with a pre-hem tool that follows a generally vertical path. Completion of the pre-hemming can be accomplished by additional travel of the pre-hem tool along the vertical path, or by the pre-hem tool as it angles away from the edges to permit final hemming. Final hemming occurs by a final die traveling along a vertical path as well.

In one mode, the pre-hem tool is mounted on a slide body, and the slide body moves vertically and then at an angle as part of the pre-hemming and final hemming operations.

Once the pre-hemming and final hemming steps are complete, the die holder and pre-hem slide are moved back to their respective start positions to start the cycle all over again. A number of hemming operations can be performed in sequence using a number of the assemblies, whereby the pre-hem slides and final die holders would be arranged and spaced vertically apart so that a single downward stroke of the apparatus would complete the pre-hemming and final hemming for a number of edges of a pair of panels.

BRIEF DESCRIPTION OF THE DRAWINGS

Reference is now made to the drawings of the invention wherein.

DESCRIPTION OF THE PREFERRED EMBODIMENTS

The present invention offers significant advantages in the field of hemming parts together, particularly automotive parts. The invention overcomes the problems of distortion and poor-quality hems when using methods and apparatus that impart an arcuate, or swinging motion to the pre-hem tool as part of a pre-hemming operation. The invention allows for the hemming of panels without the need for using such motions. In addition, the inventive apparatus produces a superior hem joint since the pre-hemming motion is a generally vertical one, and a constant downward pressure can be maintained during the hemming cycle.

In addition, the unique pre-hemming apparatus and method offers enhanced flexibility in terms of operating a number of the apparatus in groupings to accommodate the panels or parts being edged. Further, the pre-hem apparatus can be arranged with the final hem mechanism so that the hemming process can be completed in a single press cycle. The final hemming could be operated sequentially to match the cycle(s) of pre-hemming to assure that only one downward motion is needed to complete both pre-hemming and final hemming.

The inventive hemming apparatus and method are especially suited for joining panels as part of vehicle manufacture, e.g., cars and truck manufacture, but the apparatus and methodology can be used to join any panels together wherein a tight and lasting joint is required.

Figure 2:
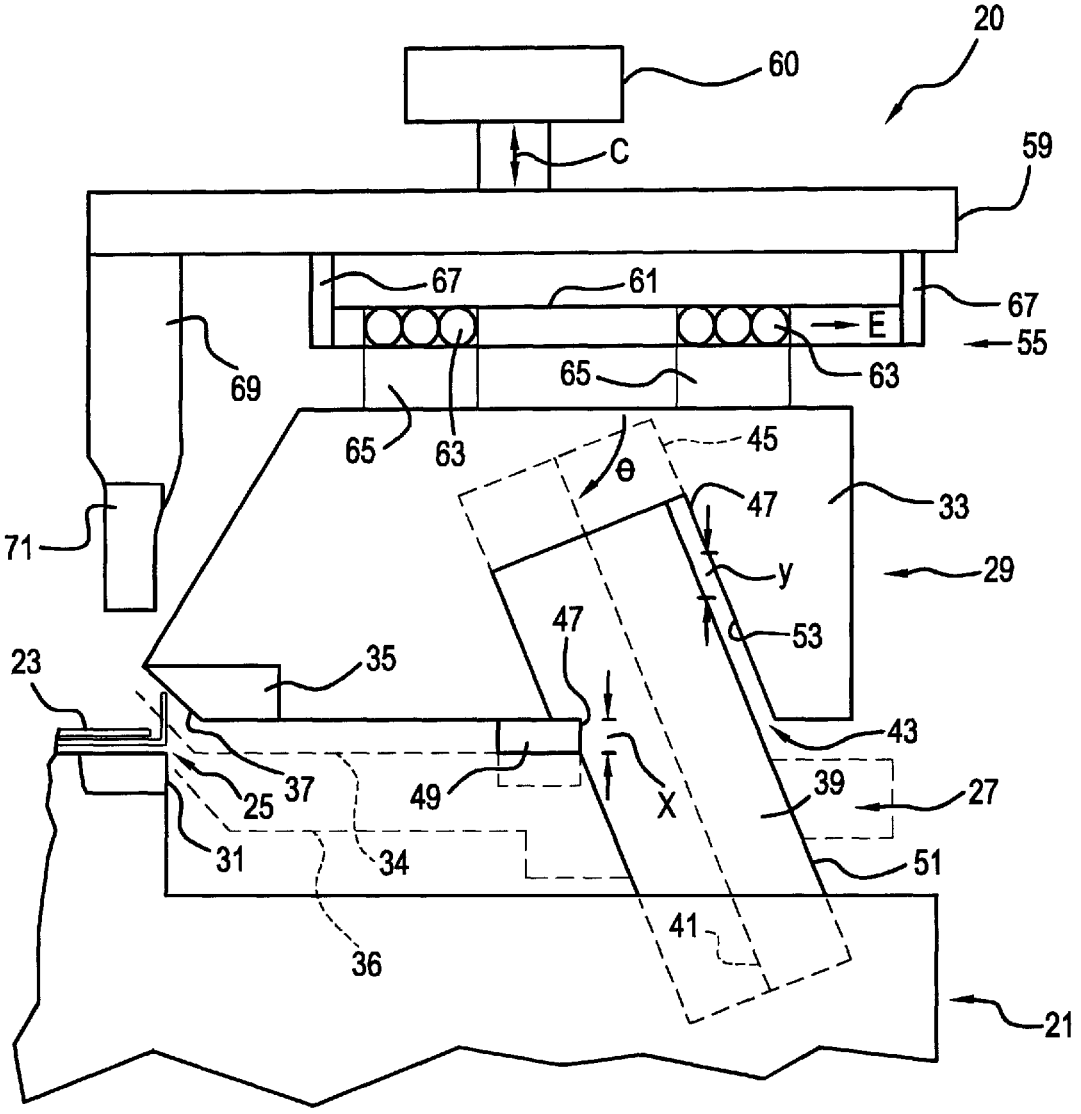
FIG. 2 is a schematic view of one embodiment of the hemming apparatus.

FIG. 2 shows one example of an apparatus employing the features of the invention. However and as will be explained below, other mechanisms than those illustrated could be employed to effect the pre-hem as well as the final hem cycles that practice the invention.

FIG. 2 is a schematic representation of one embodiment of the invention wherein the overall apparatus is generally designated by the reference numeral 20. The apparatus includes a main die and base assembly 21, that provides support for the two portions of panels 23 and 25 intended to be hemmed together.

The assembly 21 is configured with a space 27 to allow travel of a pre-hem slide 29 as explained below. The assembly 21 also supports a main die 31, which aids in forming the hem or joint between the two panels 23 and 25. It should be understood that the assembly configuration, including die shape, mounting, etc. may vary depending on the particular hemming operation to be performed, and further details of these known features is not necessary for understanding of the invention. However, the configuration should allow for the travel of the pre-hem slide 29 as explained below.

The pre-hem slide 29 comprises a slide body 33, the body supporting a pre-hem tool 35. The tool 35 has an angled tool surface 37, preferably angled at 40–50°, more preferably 45°, for hemming as will be described below.

In the embodiment of FIG. 2, the pre-hem slide 29 has a guide member 39 with its longitudinal axis 41 disposed at an angle relative to vertical and being mounted to the assembly 21. An exemplary angle of 55° is shown but other angles may be employed to effect movement of the pre-hem slide 29. The difference between the angle of the guide member 39 and the angle of the tool surface 37 comes into play when angled movement of the slide body 33 causes hemming as explained below.

The guide member 39 is disposed in an opening such as slot 43 in the slide body 33, with the body 33 having a bore 45 disposed at an end 47 of the slot 43. The bore 45 is sized to receive the guide member when the slide body 33 moves during pre-hemming.

In this embodiment, the guide member 39 has at least a pair of guide surfaces to control the path of travel of the slide body 33. First, a flat 47 is disposed along the guide member 39, with the flat having a travel distance "X". The slide body 33 has a heel block 49 disposed in opposing relationship with the flat 47. The guide member 39 also has a surface 51, and the slide body slot 43 has a complementary and opposing surface 53. This configuration controls the path of travel of the pre-hem slide as explained below.

Finally, the slide body 33 is supported by a rail and bearing assembly 55 to allow horizontal movement of the slide body 33 when appropriate. The assembly 55 is supported by a moveable upper press platen 59. The assembly 55 has a rail 61 that provides a track for roller bearings 63. The bearings 63 are linked to the slide body 33 via members 65, with the rail 61 linked to the platen 59 via members 67.

The platen 59 is moved by a drive 60 capable of providing the forces necessary for both pre-hemming and final hemming, and movement occurring in the direction shown by arrow "C".

Disposed generally opposite the main 31 and panels 23 and 25 is a final hem die holder 69 that supports the final hem tool 71. The die holder 69 is shown linked to the platen 59 such that the movement of the platen 59 will move both the die holder 69 as well as the slide body 33. Alternatively, the die holder 69 could be driven separately from the slide body 33 using another drive. In yet another mode, each of the slide body 33 and the die holder 69 could be linked to the same drive using a coupling or clutch-type mechanism so that one or both could be selectively engaged to travel. This mode, allows for independent movement of the slide body and die holder without the need for separate drives. For example, the slide body 33 could move in its cycle and then the die holder could move in its cycle. It is preferred though that each of the slide body and die holder move together since this speeds the hemming operation and improves productivity.

Referring now to FIG. 2 and FIGS. 3(*a*)–(*d*), an exemplary use of the apparatus 20 as one mode of the inventive method will now be described. In this use, the platen 59 drives both the slide body 33 and the final hem die holder 69 from a start position as shown in FIG. 2. When the platen 59 travels downwardly, the die holder 69 begins to travel downwardly and towards the panels 23 and 25. At the same time, the slide body 33 also begins to move along two paths of travel. First, by reason of the engagement between the flat 47 on the guide member 39 and the heel block 49 on the slide body 39, the slide body travels along a generally vertical path. At a certain point of this vertical travel, the surface 37 of the pre-hem tool 35 contacts the upstanding edge 75 of edge portion 77 of the panel 25. Further vertical travel of the slide body 33 causes the portion 77 to bend towards an upper face of the panel 23, FIG. 3(*b*), until the surface 37 is parallel to the surface 79 of the portion 77.

Because the pressure on the upstanding edge 77 is vertically downward, as opposed to prior art mechanisms which apply an arcing or swinging force, the panel 25 does not lift off the die 31, and a smooth undistorted pre-hem is produced.

Referring to FIG. 2 specifically, the length of the path of travel of the slide body 33 is controlled by the distance "X" and the spacing "Y." "Y" is measured vertically between the two surfaces 51 and 53. During downward travel of the slide body 33, the surface 53 will approach the stationary opposing surface 51 of the guide member 39. At the same time, the heel block 49 slides along the flat 47 the distance "X." Once the surface 53 engages surface 51, the path of travel of the slide body 33 will angle along the longitudinal axis 41 of the guide member 39. In the FIG. 2 embodiment, the slide body 33 will follow a path of travel of 55° from horizontal or 25° from vertical. Controlling distance "X" and spacing "Y" can control the length of vertical travel of the slide body. The greater "X" and "Y" are, the greater the vertical travel distance will be. It is preferred that "Y" approximate "X" so that when the heel block 49 slides off the flat 47, the surfaces 51 and 53 engage to direct the slide body 33 along the angled path of travel. "Y" cannot be less than "X" or a jam may occur by reason that the slide body is being directed vertically by flat 47 and at an angle by surface 51.

Figure 3A:
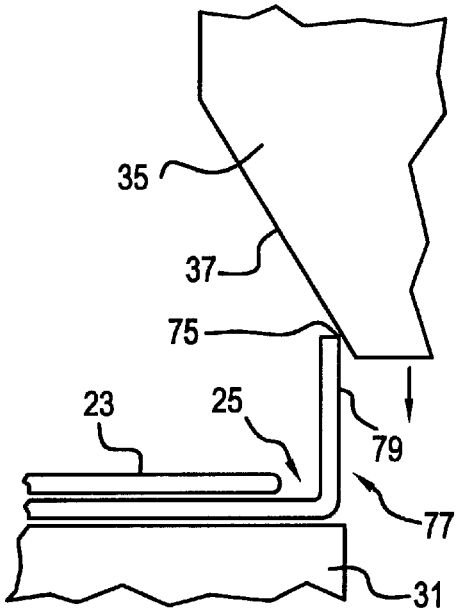
FIGS. 3*a–d* show a conventional pre-hem and final hem cycle using the apparatus of FIG. 2.
Figure 3B:
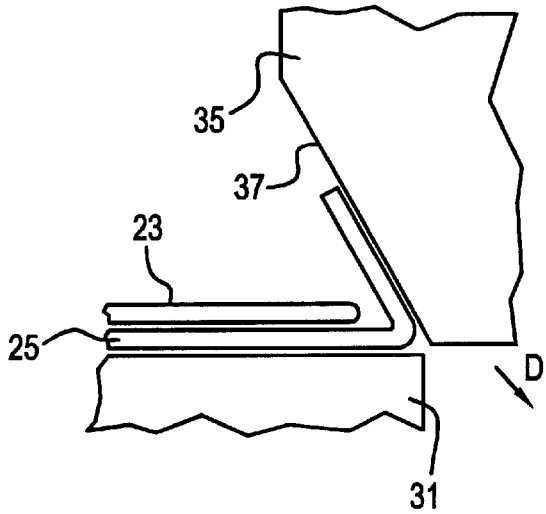
Figure 3C:
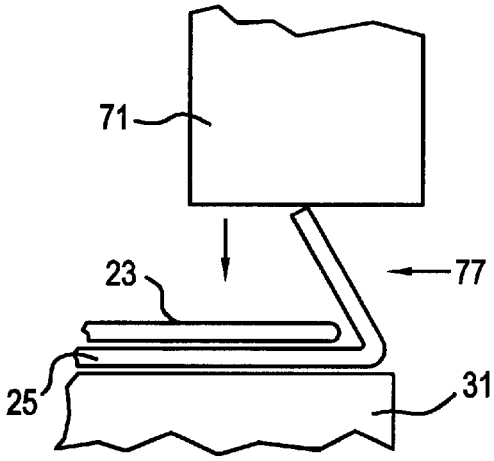
Figure 3D:
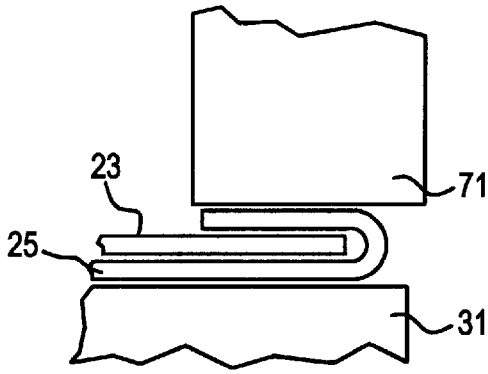

Once the vertical travel of the slide body 33 is terminated, as depicted in FIG. 3*b*, the bottom portion of the slide body 33 is positioned as shown in phantom line 34 of FIG. 2. Then, the slide body 33 begins to angle away (arrow "D" of FIG. 3*b*) or retract from the pre-hemmed panel 23, thus exposing the bent edge portion 77 for final hemming. While the slide body 33 is being retracted or angled away by guide member 39, the bearings 63 travel horizontally in the rail 61 (arrow "E"), thus maintaining the horizontal orientation of the slide body 33 as it travels along the angled guide member 39 (or the 45° angle of the surface 37.

The continued stroke of the platen 59 moves the slide body 33 toward a bottom portion of the space 27, as shown by reference numeral 36 in phantom in FIG. 2. The space 27 should be sufficient to allow the slide body 33 to retract or angle away from the panels without interference by the assembly 21. With the slide body 33 and pre-hem tool moving in the angled or retracted position, the final hem die continues to travel downwardly to contact the pre-hemmed edge 77 as shown in FIG. 3(*c*) and complete the final hemming operation, FIG. 3(*d*).

Although the distances of travel along the vertical path and the angled path can vary depending on the type of hemming operation being performed, an exemplary travel for the vertical distance is about 3/16 of an inch. The total vertical travel of the slide body, including travel along both vertical and angled paths is about 1 and ¾ inches. Thus, at the start position of FIG. 2, there should be more than 1¾-inch clearance between the base assembly 21 and the bottom of the slide body 33.

Once the hemming operation is complete and the final die holder 69 and slide body 33 are at their respective finish positions, the platen 59 is reversed, and the slide body 33 is raised at an angle along the guide member 39 until the flat 47 and heel block 49 meet. The slide body 33 then is raised in a vertical direction until the hemming operation start position of FIG. 2 is attained. Two other panels are positioned in place on the assembly 21 and the hemming operation is performed again. The timing and sequence of the removal of hemmed panels and placement of new panels for hemming can vary, since these steps are not an integral part of the inventive method.

It should be understood that other known features of hemming apparatus such as devices to hold the panels in place, move panels in place for hemming and remove hemmed panels are well known in the art, and a further description thereof is not deemed necessary for understanding of the invention.

In addition, it should also be understood that the guide member 39 and its features, and the rail assembly 55 are examples of mechanisms that would guide the slide body 33 along a vertical path, and an angled or retracting path. Other mechanisms achieving or allowing the same movement are within the scope of the invention and can be employed for pre-hemming and final hemming. Further the configuration of that disclosed in FIG. 2 can be altered as well. For example, the guide member could be a rod with a correspondingly dimensioned slot, or the member could be a bar having a square or rectangular cross section. Further, while the guide member 39 is shown disposed within a slot in the slide body and mounted to the base assembly, the guide member could be positioned adjacent and outside the slide body, and the guiding surface 53 could be arranged on an outer surface of the slide body 33 to interact with an opposing surface of the guide member 39. Other mechanisms to guide the slide body along the vertical and angled paths of travel than the pin and bushing type mechanism of FIG. 2 include the use bearings, roller, ball or the like, flat cam slide plates, cam follower type rollers, and the like. Examples are discussed below.

Similarly, the rail assembly 55 is exemplary of the well known T.H.K. type rails, and other mechanisms that would maintain the horizontal alignment of the slide body during its angled travel could be employed, e.g., guide bars and bushings, wear plate slides and keepers, and the like. Examples of these are also discussed below.

Figure 1A:
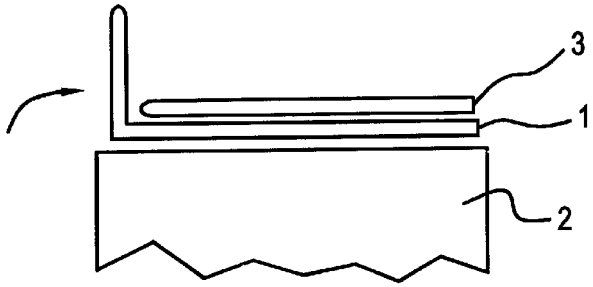
FIGS. 1*a* and 1*b* are schematic representations of a prior art pre-hemming operation.
Figure 1B:
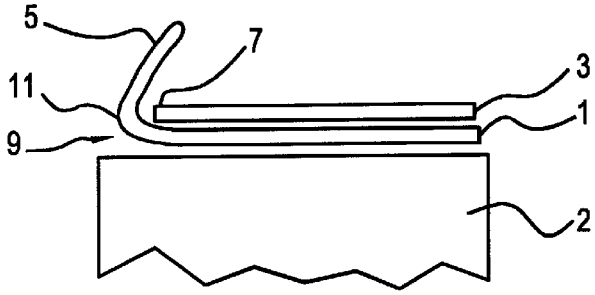
Figure 4A:
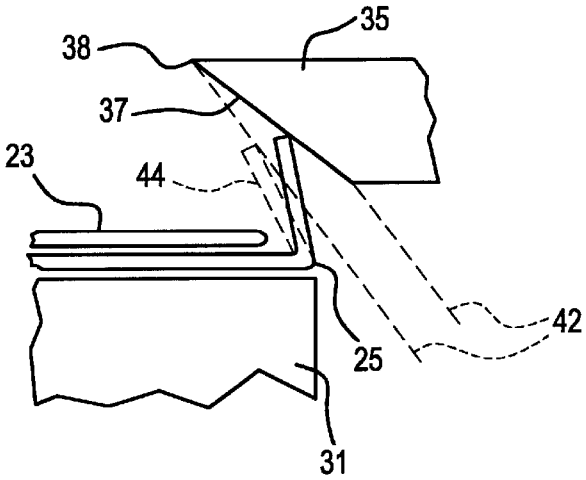
FIGS. 4*a* and 4*b* show exemplary pre-hem cycles using the apparatus of FIG. 2.

FIGS. 2 and 3*a*–3*d* are intended to show a pre-hemming operation wherein the pre-hemming action continues when the vertical travel of the slide body stops. This mode is shown in FIG. 4*a*, wherein the tool 35 is shown in contact with a partially pre-hemmed edge 77 at the point where vertical travel stops. The tool then begins its angled and retractive movement along the hatched lines 42. Since the surface 37 is at a different angle (45°) than the axis of the slide body (55°), surface 37 of the tool 35 continues to contact the edge 77, thus further bending or pre-hemming the edge as shown in hatched lines 44. Eventually, as the surface 37 continues to angle, the portion 77 will achieve the angle of retraction, and the tool 35 will fully retract for final hemming.

Figure 4B:
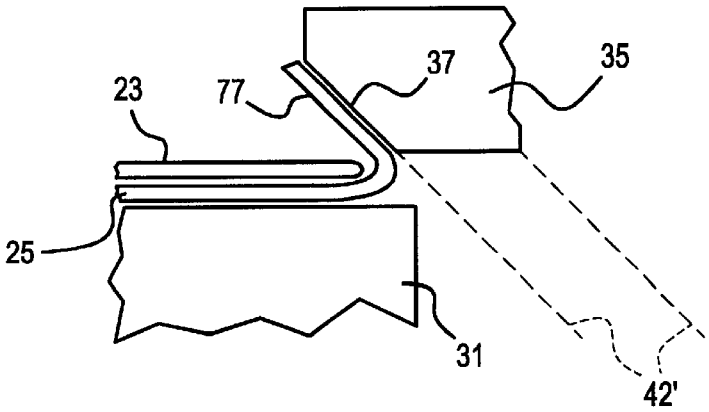

In the mode of FIG. 4*b*, the guide member 39 is at the same inclination as the tool surface 37 of tool 35, and the tool 35 is shown in the position where vertical travel has ceased. Retraction of the tool 35 along the path 42' and 42' produces no further pre-hemming action, the edge 77 has been bent at an angle corresponding to the tool surface 37. Thus, by altering the angle of the guide member 39 and/or tool surface 37, the degree of pre-hemming during vertical travel can change. For example, in FIG. 4*b*, the angle of the tool surface matches the angle of travel of the slide body so that pre-hemming stops once vertical travel stops. When the slide body angle, θ in FIG. 2, is greater than the angle of surface 37, bending of the upstanding edge can still occur during angled travel of the tool surface 37.

The angle θ also controls the rate of travel of the slide body 33. The angle of 55° allows the slide body to retract from the pre-hemmed panels at a relatively slower rate, whereas configuring the guide member to a less steep angle, e.g., 45°, causes the slide body to travel at a higher rate during the retractive movement (less distance is covered.)

It is preferred to do most of the pre-hemming during vertical travel since imparting a downward force on the upstanding edge results in a better pre-hemmed configuration, than using a swinging or arcuate motion as down in the prior art. However, it is also preferred that the slide body move at a more controlled rate rein the axis 41 of the guide member 39 is at an angle steeper than the angle of the tool surface 37, e.g., 55° for the axis 41 and a 45° angle for the tool surface 37. In this mode, due to the angular difference, the angled movement of the tool surface causes further bending of the upstanding edge.

In either mode of FIG. 4*a* or 4*b*, the edges are at least partially pre-hemmed during vertical travel of the slide body. Completion of the pre-hemming can occur in the vertical travel mode, or be completed as part of the retraction and angling away of the pre-hem tool to expose the pre-hemmed edges for final hemming.

As noted above, the inventive method and apparatus is particularly useful for performing a number of hemming operations together. In addition, it is preferred to employ the hemming operation on panels such as hoods, deck lids, doors, and the like that are employed in vehicles such as cars and trucks.

Figure 5A:
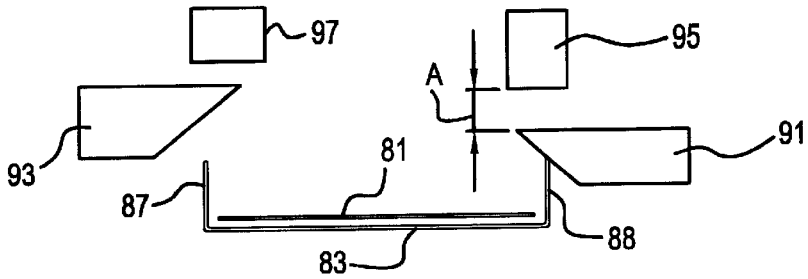
FIGS. 5*a–e* show a sequential hemming cycle of a pair of edges of one panel to another panel.
Figure 5B:
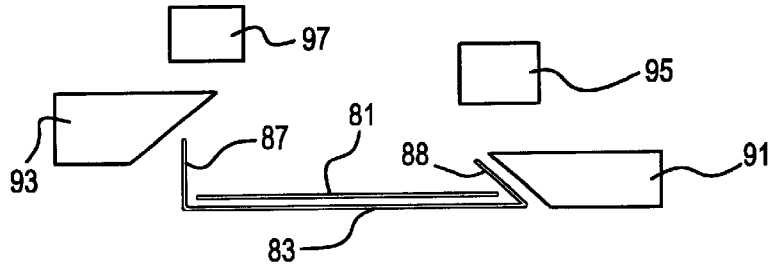

Referring now to FIGS. 5*a*–5*e*, a cycle is illustrated wherein a cowl, latch and fender sides of a vehicle hood are hemmed. These figures only show those components of the inventive apparatus necessary for understanding of the hemming cycle to be described. The cycle is performed on a first panel 81 that is disposed within a second panel 83, each panel making up the hood. Panel 83 has a pair of upstanding edges 87 and 88, with edge 87 being representative of the edges on the cowl and latch sides, and edge 88 being representative of the fender edges. FIG. 5*a* shows a pair of pre-hem tools 91 and 93, spaced apart vertically by distance "A." When the cycle begins, the tool 91 contacts edge 88 with tool 93 still spaced from edge 87. Tool 91 begins the pre-hemming operation in FIG. 5*b* with tool 93 coming into contact with edge 87.

Figure 5C:
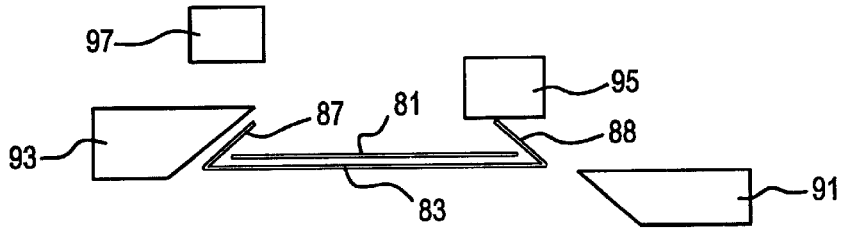
Figure 5D:
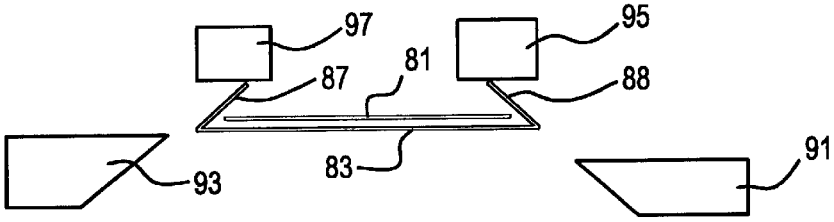

FIG. 5*c* shows that tool 91 is angularly retracted while tool 93 completes the pre-hem on edge 87. During the pre-hemming of edge 87, the final hem tool 95 contacts the pre-hemmed edge 88 to initiate the final hemming step. FIG. 5*d* shows that while final hemming is at about the 50% completion stage on edge 88, the final hem tool 97 contacts the edge 87. In FIG. 5*d*, tool 93 is retracted from the edge 87 to permit final hemming of pre-hemmed edge 88.

Figure 5E:
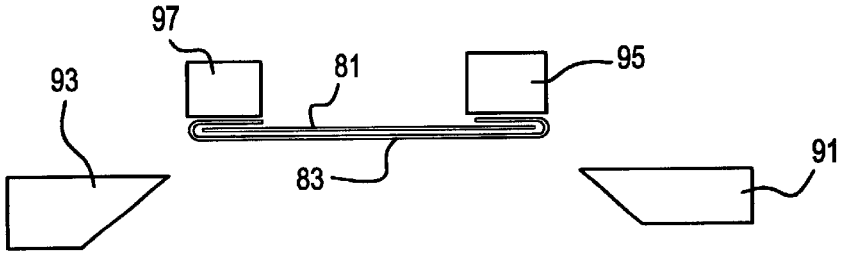

FIG. 5*e* shows the final hem stage wherein each of the final hem tools 95 and 97 flatten the edge 87 to form the desired joint. It should be understood that in the embodiment of FIG. 5, the set of tools 91 and 95 moves as one stroke, and the set 93 and 97 moves as a second stroke. In other words, the pre-hem slide 91 reaches it finish position as its corresponding final hem tool 95 completes the final hemming operation. Likewise, tool 93 reaches its finish position when the die 97 completes its final hemming. The stroke for tools 91 and 95 is completed first, and the stroke for tools 93 and 97 are completed second. Of course, the sets of tools could be positioned with respect to each other and the edges of the panels so that the stroke of each would finish at the same time. For example, the pre-hemming and final hemming of edges 87 and 88 would occur in unison.

Once the hemming is completed, the tools 91, 93, 95, and 97 would then be raised (either together or in sequence) from the finish position to the start position. Another set of panels would then be positioned on the die, and the sequence would begin again. It should be understood that the use of a pair pre-hem and final hem tools is exemplary, and any number of tools can be employed in combination to pre-hem and final hem a number of panel edges together. While a vehicle hood is exemplified, other parts requiring hemming can also be employed.

The inventive method entails the use of a pre-hemming step as part of a conventional hemming operation wherein at least a portion of the pre-hemming action takes place with the pre-hemming tool moving in a vertical direction. The pre-hemming can be completed vertically, or vertically and as part of the angular or retractive movement of the pre-hem tool in preparation for final hemming. Final hemming is then performed with the final hem tool being vertically driven against the pre-hemmed edges of the panels.

In a preferred mode of the invention, pre-hemming is attained by guiding the pre-hem slide using at least one flat surface, and at least one angled surface. Of course, a number of surfaces could be employed depending on the exact configuration of the mechanism employed for guiding of the vertical and angled travel of the pre-hem slide. It is also preferred that the pre-hem slide be maintained in the same orientation during vertical and angled travel so that the angled surface of the pre-hem tool does not change during pre-hem slide travel. This is accomplished in one mode by having the pre-hem slide follow a horizontal rail via bearings during the angled movement. Other modes could be employed as well to maintain the proper orientation of the pre-hem slide.

Figure 6A:
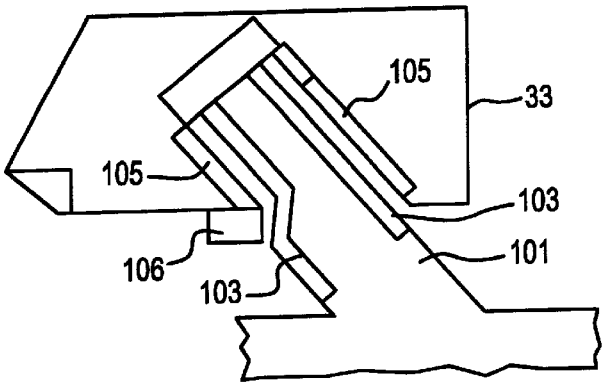
FIGS. 6*a* and 6*b* show a first alternative mechanism for the pre-hemming mechanism of FIG. 2.
Figure 6B:
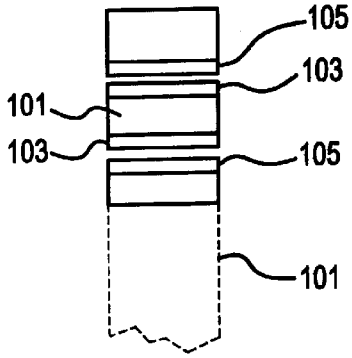
Figure 7A:
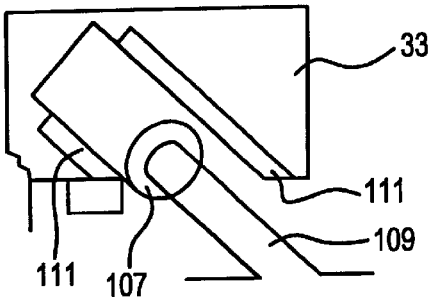
FIGS. 7*a* and 7*b* shows a second alternative for the FIG. 2 pre-hemming mechanism.
Figure 7B:
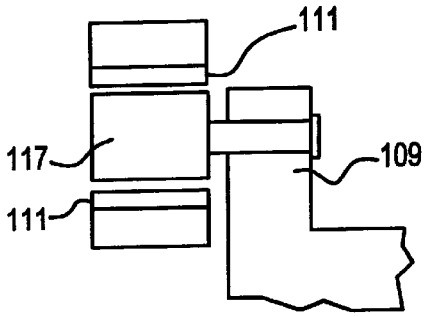

Referring now to FIGS. 6*a*–10, alternative configurations are illustrated for moving the slide body, both vertically and at an angle. FIGS. 6*a* and 6*b* show a guide member 101 having wear plates 103, with the slide body 33 having complementary wear plates 105, and a heel block 106. FIGS. 7*a* and 7*b* show the use of a cam follower 107 rotatably supported by upright 109. The slide body 33 has a pair of wear plates 111, which are configured to contact the cam follower during slide body movement.

Figure 8:
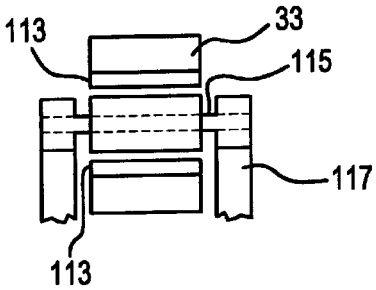
FIG. 8 is yet another pre-hemming mechanism.

FIG. 8 shows a roller bearing 113 mounted on a pin 115, the pin 115 being supported by bearing supports 117. Again, the slide body has a pair of wear plates 119 for contact with the bearing 113 during slide body travel.

Figure 9:
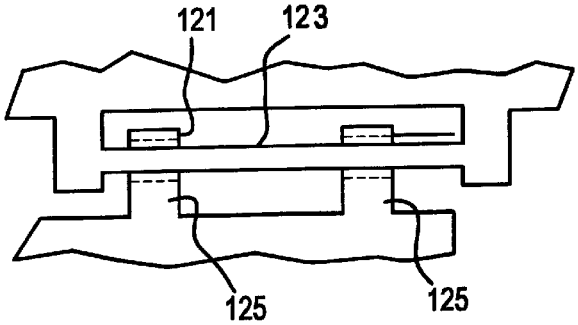
FIG. 9 is an alternative mechanism for horizontal guiding of the pre-hemming tool.

FIG. 9 shows an alternative horizontal motion mechanism wherein the slide body 33 employs guide bar bushings 121 to slid along the rail 123. The bushings are mounted in guide bar bushing mounting and retaining blocks 125 that extend from the slide body 33.

Figure 10:
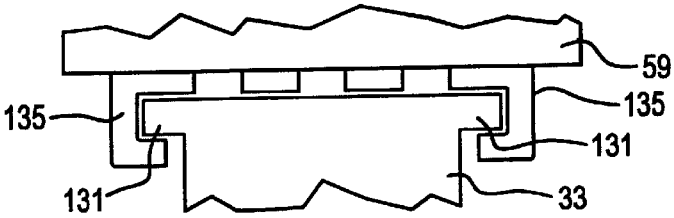
FIG. 10 is another alternative horizontal guiding mechanism.

FIG. 10 shows another mechanism employing side keepers and hold downs. It should be understood that in this embodiment, the travel path of the slide body 33 is such that the protrusions 131 travel within the side keepers/hold downs 135 and against wear plates 137 situated between the slide body 33 and the upper platen 59 (perpendicular to the plane of the drawing). In each of the embodiments of FIGS. 6*a*–10, the slide body 33 travels in the same manner as described for FIG. 2. As stated above, the mechanisms depicted in FIGS. 6*a*–10 are exemplary of those mechanisms capable of controlling the travel path of the slide body in the vertical, angled, and horizontal directions, and mechanisms other than those shown can be employed without departing from the invention.

As such, an invention has been disclosed in terms of preferred embodiments thereof which fulfills each and every one of the objects of the present invention as set forth above and provides new and improved hemming assembly and method.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A die hemming apparatus assembly for hemming an upstanding edge of a first panel to an edge of a second panel to form a joint comprising:

a) a main die supporting the first and second panels;

b) a pre-hem slide supporting a pre-hem tool having an angled tool surface, the pre-hem slide also having a pre-hem slide vertical surface and a pre-hem slide angled surface;

c) a final hem die holder supporting a final hem tool;

d) a guide mechanism having a guide vertical surface and a guide angled surface, engagement between the pre-hem slide vertical surface and the guide vertical surface directing the pre-hem slide along a first path generally vertical to the upstanding edge and engagement between the pre-hem slide angled surface and the guide angled surface directing the pre-hem slide along a second path angled with respect to vertical; and e) at least one drive to direct the pre-hem slide along the first and second paths and to direct the final hem die holder along a generally vertical path.

2. The assembly of claim 1, comprising one drive for the final die holder and one drive for the pre-hem slide.

3. The assembly of claim 1, further comprising a plurality of the assemblies arranged to hem a plurality of edges together.

4. The assembly of claim 3, wherein a plurality of assemblies are provided and are vertically arranged with respect to each other so that pre-hemming and final hemming performed by the assemblies is done sequentially.

5. The assembly of claim 1, wherein the guide mechanism further comprises an elongated element having the guide vertical surface and the guide angled surface.

6. The assembly of claim 5, wherein the guide mechanism further comprises a horizontal guide to maintain a horizontal orientation of a slide body of the pre-hem slide during angling movement of the pre-hem slide.

7. The assembly of claim 1, wherein the main die is supported by a base, the main die and the base forming a space to receive the pre-hem slide during angling movement thereof.

8. The assembly of claim 6, wherein the horizontal guide further comprises a rail disposed generally horizontally and linked to the drive, and bearings disposed in the rail, the bearings linked to the pre-hem slide, horizontal travel of the bearings in the rail maintaining the horizontal orientation.

9. The assembly of claim 6, wherein the angle of the tool surface and the second path are selected so that pre-hemming is completed during travel of the pre-hem slide along the second path.

10. In a hemming apparatus adapted to join an upstanding edge of a first panel to an edge of a second panel and employing a vertically driven final die holder, the improvement comprising a pre-hemming tool holder supporting a pre-hem tool, the pre-hemming tool holder having a holder vertical surface and a holder angled surface, and a guide mechanism having a guide vertical surface and a guide angled surface, engagement between the holder vertical surface and the guide vertical surface first guiding the pre-hemming tool holder along a generally vertical travel path for at least a partial pre-hemming of the edges, and then engagement between the holder angled surface and the guide angled surface guiding the pre-hemming tool along a path angled with respect to the generally vertical path to expose the pre-hemmed edges for one of final hemming or completion of pre-hemming and final hemming.

11. A method of hemming an upstanding edge of a first panel to an edge of a second panel to form a joint comprising:

a) driving a pre-hem tool having an angled tool surface along a vertical path by contact between a first vertical surface on a pre-hem tool holder, and a second vertical surface on a guide element, the angled tool surface contacting the upstanding edge of the first panel to bend the upstanding edge towards an upper face of the second panel to form at least a partially pre-hem edge;

b) angling the pre-hem tool away from the at least partially pre-hemmed edge by contact between a first angled surface on a pre-hem tool angled relative to the first vertical surface and a second angled surface on the guide element angled relative to the second vertical surface to either expose a surface of a fully pre-hemmed edge or complete pre-hemming and further expose a surface of a fully pre-hemmed edge; and c) driving a final hem tool vertically against the exposed surface of the pre-hemmed edge to hem the edges of the first and second panels together.

12. The method of claim 11, wherein after step (c), the final hem tool and pre-hem tool are driven back to start positions for further hemming.

13. The method of claim 11, wherein the final hem tool is moving vertically from a final hemming start position to a final hemming finish position during driving and angling of the pre-hem tool between a pre-hemming start position to a pre-hemming finish position, whereby pre-hemming and final hemming is completed during movement of the pre-hem and final hem tools.

14. The method of claim 11, further comprising mounting the pre-hem tool on a slide body, and guiding the slide body vertically during step (a) and guiding the slide body at an angle with respect to vertical during step (b).

15. The method of claim 11, wherein the first panel has a plurality of upstanding edges and the second panel has a plurality of edges, and steps (a) and (b) drive and retract a plurality of the pre-hem tools, and step (c) drives a plurality of the final hem tools as part of one stroke to complete both pre-hemming and final hemming of the upstanding edges of the first panel and the edges of the second panel.

16. The method of claim 14, further comprising maintaining a generally horizontal orientation of the pre-hem slide during step (b).

17. The method of claim 11, wherein full pre-hemming is completed in step (b).

18. The method of claim 11, wherein the angle of the path of travel of the pre-hem tool is between about 40 and 60° from horizontal.

19. In a method of pre-hemming and final hemming an upstanding edge of a first panel to an edge of a second panel, the improvement comprising at least partially pre-hemming the edges together by first directing a pre-hemming tool generally vertically against the upstanding edge, and then angling the pre-hemming tool away from the edges to complete pre-hemming and expose the pre-hemmed edges for final hemming, wherein directing the pre-hemming tool assembly vertically occurs by contact between a vertical surface on the tool assembly and a stationary vertical surface.

20. The method of claim 19, wherein directing the pre-hemming tool generally vertically against the upstanding edge, fully pre-hems the edges and then angling the pre-hemming tool away from the edges exposes the fully pre-hemmed edges for final hemming.

21. A die hemming apparatus assembly for hemming an upstanding edge of a first panel to an edge of a second panel to form a joint comprising:

a) a main die supporting the first and second panels;

b) a pre-hem slide supporting a pre-hem tool having an angled tool surface;

c) a final hem die holder supporting a final hem tool;

d) a guide mechanism in engagement with the pre-hem slide to direct the pre-hem slide along a first path generally vertical to the upstanding edge and along a second path angled with respect to vertical; and e) at least one drive to direct the pre-hem slide along the first and second paths and to direct the final hem die holder along a generally vertical path;

f) wherein the guide mechanism comprises an elongated element having at least one vertical guide surface and at least one angled guide surface, the pre-hem slide having at least one complementary vertical guide surface and at least one complementary angled guide surface, movement of the at least one complementary vertical guide surface of the pre-hem slide against the at least one vertical guide surface of the guide member directing the pre-hem tool generally vertically against the upstanding edge for at least a partial pre-hemming, and movement of the at least one complementary angled guide surface of the pre-hem slide against the at least one angled guide surface of the guide member angling the pre-hem tool away from the pre-hemmed edge to permit one of final hemming or completion of pre-hemming and final hemming.

* * * * *